US007997661B2

(12) United States Patent
Hall et al.

(10) Patent No.: US 7,997,661 B2
(45) Date of Patent: Aug. 16, 2011

(54) TAPERED BORE IN A PICK

(75) Inventors: David R. Hall, Provo, UT (US); Scott Dahlgren, Alpine, UT (US); Joe Fox, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 274 days.

(21) Appl. No.: 11/773,271

(22) Filed: Jul. 3, 2007

(65) Prior Publication Data

US 2008/0211290 A1 Sep. 4, 2008

Related U.S. Application Data

(63) Continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/773,271 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/113; 299/105

(58) Field of Classification Search ..... 299/113, 299/111, 104, 105
See application file for complete search history.

(56) References Cited

U.S. PATENT DOCUMENTS 2,004,315 A 6/1935 Fean
(Continued)

FOREIGN PATENT DOCUMENTS

DE 3307910 9/1984
(Continued)

OTHER PUBLICATIONS

Kennametal Inc., catalog, "Construction Tools," 1997, pp. 1-20 (This NPL document was cited in the co-owned U.S. Appl. Nos. 11/464,008 and 11/463,998).

*Primary Examiner* — John Kreck
(74) *Attorney, Agent, or Firm* — Holme Roberts & Owen LLP

(57) ABSTRACT

In one aspect of the present invention, a high impact resistant excavation pick having a super hard material is bonded to a cemented metal carbide substrate at a non-planar interface. The cemented metal carbide substrate is bonded to a front end of a cemented metal carbide frustum. A tapered bore is formed in the base end of the carbide frustum opposite the front end and a steel shank with a tapered interface is fitted into the tapered bore.

17 Claims, 11 Drawing Sheets

U.S. PATENT DOCUMENTS 2,124,438 A 7/1938 Struk et al.
3,254,392 A 6/1966 Novkov
3,342,531 A 9/1967 Krekeler
3,342,532 A * 9/1967 Krekeler ..... 299/107
3,397,012 A 8/1968 Krekeler
3,512,838 A * 5/1970 Kniff ..... 299/104
3,650,565 A 3/1972 Kniff
3,655,244 A * 4/1972 Swisher ..... 299/113
3,746,396 A 7/1973 Radd
3,807,804 A 4/1974 Kniff
3,830,321 A 8/1974 McKenry et al.
3,932,952 A 1/1976 Helton et al.
3,942,838 A 3/1976 Bailey et al.
3,945,681 A 3/1976 White
3,957,307 A 5/1976 Varda
4,005,914 A 2/1977 Newman
4,006,936 A 2/1977 Crabiel
4,098,362 A 7/1978 Bonnice
4,109,737 A 8/1978 Bovenkerk
RE29,900 E 2/1979 Kniff
4,156,329 A 5/1979 Daniels et al.
4,199,035 A 4/1980 Thompson
4,201,421 A 5/1980 Den Besten et al.
4,247,150 A 1/1981 Wrulich et al.
4,268,089 A 5/1981 Spence et al.
4,277,106 A 7/1981 Sahley
4,397,362 A 8/1983 Dice et al.
4,439,250 A 3/1984 Acharya et al.
4,465,221 A 8/1984 Schmidt
4,484,644 A 11/1984 Cook et al.
4,484,783 A 11/1984 Emmerich
4,489,986 A 12/1984 Dziak
4,497,520 A 2/1985 Ojanen
4,537,448 A 8/1985 Ketterer
4,542,942 A 9/1985 Zitz et al.
4,583,786 A 4/1986 Thorpe et al.
4,627,665 A 12/1986 Ewing et al.
4,660,890 A 4/1987 Mills
4,678,237 A 7/1987 Collin
4,682,987 A 7/1987 Brady et al.
4,684,176 A 8/1987 Den Besten et al.
4,688,856 A 8/1987 Elfgen
4,702,525 A 10/1987 Sollami et al.
4,725,098 A 2/1988 Beach
4,728,153 A 3/1988 Ojanen et al.
4,729,603 A 3/1988 Elfgen
4,736,533 A 4/1988 May et al.
4,746,379 A 5/1988 Rabinkin
4,765,686 A 8/1988 Adams
4,765,687 A 8/1988 Parrott
4,776,862 A 10/1988 Wiand
4,798,026 A 1/1989 Cerceau
4,804,231 A 2/1989 Buljan et al.
4,811,801 A 3/1989 Salesky et al.
4,836,614 A 6/1989 Ojanen
4,850,649 A 7/1989 Beach
4,880,154 A 11/1989 Tank
4,893,875 A 1/1990 Lonn et al.
4,921,310 A 5/1990 Hedlund
D308,683 S 6/1990 Meyers
4,932,723 A 6/1990 Mills
4,940,288 A 7/1990 Stiffler et al.
4,944,559 A 7/1990 Sionnet et al.
4,951,762 A 8/1990 Lundell
5,007,685 A 4/1991 Beach et al.
5,011,515 A 4/1991 Frushour
5,106,166 A 4/1992 O'Neill
5,112,165 A 5/1992 Hedlund et al.
5,141,289 A 8/1992 Stiffler
5,154,245 A 10/1992 Waldenstrom et al.
5,186,892 A 2/1993 Pope
5,251,964 A 10/1993 Ojanen
5,261,499 A 11/1993 Grubb
5,303,984 A 4/1994 Ojanen
5,332,348 A 7/1994 Lemelson
5,415,462 A 5/1995 Massa et al.
5,417,475 A 5/1995 Graham et al.
5,447,208 A 9/1995 Lund
5,494,477 A 2/1996 Flood et al.
5,503,463 A 4/1996 Ojanen
5,535,839 A 7/1996 Brady
5,542,993 A 8/1996 Rabinkin
5,653,300 A 8/1997 Lund et al.
5,720,528 A 2/1998 Ritchey
5,725,283 A 3/1998 O'Neill
5,730,502 A 3/1998 Montgomery, Jr.
5,738,415 A 4/1998 Parrott
5,738,698 A 4/1998 Kapoor et al.
5,823,632 A 10/1998 Burkett
5,837,071 A * 11/1998 Andersson et al. ..... 148/528
5,845,547 A 12/1998 Sollami
5,875,862 A 3/1999 Jurewicz et al.
5,884,979 A 3/1999 Latham
5,934,542 A 8/1999 Nakamura et al.
5,935,718 A 8/1999 Demo et al.
5,944,129 A 8/1999 Jensen
5,967,250 A 10/1999 Lund et al.
5,992,405 A 11/1999 Sollami
6,006,846 A 12/1999 Tibbitts et al.
6,019,434 A 2/2000 Emmerich
6,044,920 A 4/2000 Massa et al.
6,051,079 A 4/2000 Andersson et al.
6,056,911 A 5/2000 Griffin
6,065,552 A 5/2000 Scott et al.
6,102,486 A 8/2000 Briese
6,113,195 A 9/2000 Mercier et al.
6,170,917 B1 1/2001 Heinrich et al.
6,193,770 B1 2/2001 Sung
6,196,636 B1 3/2001 Mills et al.
6,196,910 B1 3/2001 Johnson et al.
6,199,956 B1 3/2001 Kammerer
6,216,805 B1 4/2001 Lays et al.
6,270,165 B1 8/2001 Peay
6,341,823 B1 1/2002 Sollami
6,354,771 B1 3/2002 Bauschulte et al.
6,357,832 B1 3/2002 Sollami
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen et al.
6,481,803 B2 11/2002 Ritchey
6,499,547 B2 12/2002 Scott et al.
6,508,516 B1 1/2003 Kammerer
6,517,902 B2 2/2003 Drake et al.
RE38,151 E 6/2003 Penkunas et al.
6,585,326 B2 7/2003 Sollami
6,585,327 B2 7/2003 Sollami
6,644,755 B1 11/2003 Kammerer
6,659,206 B2 12/2003 Liang et al.
6,685,273 B1 2/2004 Sollami
6,692,083 B2 2/2004 Latham
6,702,393 B2 3/2004 Mercier
6,709,065 B2 3/2004 Peay et al.
6,719,074 B2 4/2004 Tsuda et al.
6,732,914 B2 5/2004 Cadden et al.
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,863,352 B2 3/2005 Sollami
6,880,744 B2 4/2005 Noro
6,889,890 B2 5/2005 Yamazaki et al.
6,962,395 B2 11/2005 Mouthaan
6,966,611 B1 11/2005 Sollami
6,994,404 B1 2/2006 Sollami
7,094,473 B2 8/2006 Takayama et al.
7,204,560 B2 4/2007 Mercier et al.
7,380,888 B2 6/2008 Ojanen
7,384,105 B2 6/2008 Hall et al.
2003/0209366 A1 11/2003 McAlvain
2003/0230926 A1 12/2003 Mondy
2004/0026983 A1 2/2004 McAlvain

| | | | |
|---|---|---|---|
| 2004/0065484 | A1 | 4/2004 | McAlvain |
| 2005/0159840 | A1 | 7/2005 | Lin et al. |
| 2006/0125306 | A1 | 6/2006 | Sollami |
| 2006/0237236 | A1 | 10/2006 | Sreshta et al. |

FOREIGN PATENT DOCUMENTS

| | | | |
|---|---|---|---|
| DE | 3500261 | | 7/1986 |
| DE | 3818213 | | 11/1989 |
| DE | 4039217 | | 6/1992 |
| DE | 19821147 | | 11/1999 |
| DE | 10163717 | | 5/2003 |
| EP | 0295151 | | 6/1988 |
| EP | 0412287 | | 7/1990 |
| EP | 1574309 | | 9/2005 |
| GB | 2004315 | | 3/1979 |
| GB | 2037223 | | 11/1979 |
| JP | 5280273 | A | 3/1992 |
| JP | 2002-081524 | | 3/2002 |

* cited by examiner 1000H
1003H
900H
1001H
1002H
201H 1003I
1000I
900I
1001I
201I 1001J
1000J
1003J
900J
1004
201J 1001K
1000K
1003K
900K
1005
201K 1000L
1003L
900L
1001L
201L 1001M
1000M
1003M
900M
201M 1001N
1000N
1003N
900N
1008
1009
1018
201N 1012
1000P
1011
1010
1022
900P
1024
201P

TAPERED BORE IN A PICK

CROSS REFERENCE TO RELATED APPLICATIONS

This application is a continuation-in-part of U.S. patent application Ser. No. 11/766,903 filed on Jun. 22, 2007, which is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and is now U.S. Pat. No. 7,475,948 that issued on Jan. 13, 2009. U.S. patent application Ser. No. 11/742,304 is a continuation of U.S. patent application Ser. No. 11/742,261 filed on Apr. 30, 2007 and is now U.S. Pat. No. 7,469,971 that issued on Dec. 16, 2008. U.S. patent application Ser. No. 11/742,261 is a continuation-in-part of U.S. patent application Ser. No. 11/464,008 filed on Aug. 11, 2006 and is now U.S. Pat. No. 7,338,135 that issued on Mar. 4, 2008. U.S. patent application Ser. No. 11/464,008 is a continuation-in-part of U.S. patent application Ser. No. 11/463,998 filed on Aug. 11, 2006 and is now U.S. Pat. No. 7,384,105 that issued on Jun. 10, 2008. U.S. patent application Ser. No. 11/463,998 is a continuation-in-part of U.S. patent application Ser. No. 11/463,990 filed on Aug. 11, 2006 and is now U.S. Pat. No. 7,320,505 that issued on Jan. 22, 2008. U.S. patent application Ser. No. 11/463,990 is a continuation-in-part of U.S. patent application Ser. No. 11/463,975 filed on Aug. 11, 2006 and is now U.S. Pat. No. 7,445,294 that issued on Nov. 4, 2008. U.S. patent application Ser. No. 11/463,975 is a continuation-in-part of U.S. patent application Ser. No. 11/463,962 filed on Aug. 11, 2006 and is now U.S. Pat. No. 7,413,256 that issued on Aug. 19, 2008. U.S. patent application Ser. No. 11/463,962 is a continuation-in-part of U.S. patent application Ser. No. 11/463,953, also filed on Aug. 11, 2006 and is now U.S. Pat. No. 7,464,993 that issued on Dec. 16, 2008. The present application is also a continuation-in-part of U.S. patent application Ser. No. 11/695,672 filed on Apr. 3, 2007. U.S. patent application Ser. No. 11/695,672 is a continuation-in-part of U.S. patent application Ser. No. 11/686,831 filed on Mar. 15, 2007 and is now U.S. Pat. No. 7,568,770 that issued on Aug. 4, 2009. All of these applications are herein incorporated by reference for all that they contain.

BACKGROUND OF THE INVENTION

Formation degradation, such as asphalt milling, mining, or excavating, may result in wear on attack tools. Consequently, many efforts have been made to extend the life of these tools.

U.S. Pat. No. 5,702,160 to Levankovskii et al., which is herein incorporated by reference for all that it contains discloses a tool for crushing hard material comprising a housing and a hard-alloy insert mounted on the latter. The insert is made up of a head portion, an intermediate portion and a base with a thrust face. The intermediate portion of the insert is formed by a body of resolution with an outer lateral surface of concave shape. The head portion of the insert is formed by a body of revolution with an outer lateral surface of convex shape. The lateral side of the head portion of the insert is smoothly located adjacent to the lateral side of the intermediate portion of the insert about its longitudinal axis does not exceed the length of the head portion of the insert about the same axis.

U.S. Pat. No. 3,830,321 to McKenry et al., which is herein incorporated by reference for all that it contains, discloses an excavating tool and a bit for use therewith in which the bit is of small dimensions and is mounted in a block in which the bit is rotatable and which block is configured in such a manner that it can be welded to various types of holders so that a plurality of blocks and bits mounted on a holder make an excavating tool of selected style and size.

U.S. Pat. No. 6,102,486 to Briese, which is herein incorporated by reference for all that it contains, discloses a frustum cutting insert having a cutting end and a shank end and the cutting end having a cutting edge and inner walls defining a conical tapered surface. First walls in the insert define a cavity at the inner end of the inner walls and second walls define a plurality of apertures extending from the cavity to regions external the cutting insert to define a powder flow passage from regions adjacent the cutting edge, past the inner walls, through the cavity and through the apertures.

U.S. Pat. No. 4,944,559 to Sionnet et al., which is herein incorporated by reference for all that it contains, discloses a body of a tool consisting of a single-piece steel component. The housing for the composite abrasive component is provided in this steel component. The working surface of the body has, at least in its component-holder part, and angle at the lower vertex of at least 20% with respect to the angle at the vertex of the corresponding part of a metallic carbide tool for working the same rock. The surface of the component holder is at least partially covered by an erosion layer of hard material.

U.S. Pat. No. 5,873,423 to Briese, which is herein incorporated by reference for all that it contains, discloses a frustum cutting bit arrangement, including a shank portion for mounting in, and to be retained by, a rotary cutting tool body, the shank portion having an axis, an inner axial end, and an outer axial end. A head portion has an axis coincident with the shank portion axis, a front axial end, and a rear axial end, the rear end coupled to the shank portion outer end, and the front end having a conical cavity therein diminishing in diameter from the front end toward the rear end. A frustum cutting insert has an axis coincident with the head portion axis, a forward axial end, a back axial end, and an outer conical surface diminishing in diameter from the forward end toward the back end, the conical cavity in a taper lock. In variations of the basic invention, the head portion may be rotatable with respect to the shank portion, the frustum cutting insert may comprise a rotating cutter therein, and combinations of such features may be provided for different applications.

BRIEF SUMMARY OF THE INVENTION

In one aspect of the present invention, a high impact resistant pick having a super hard material is bonded to a cemented metal carbide substrate at a non-planar interface. The cemented metal carbide substrate is bonded to a front end of a cemented metal carbide bolster. A tapered bore is formed in the base end of the carbide bolster generally opposed to the front end and a steel shank with a tapered interface is fitted into the tapered bore.

The tapered interface may be a Morse taper, a Brown taper, a Sharpe taper, a R8 taper, a Jacobs taper, a Jarno taper, a NMTB taper, or modifications or combinations thereof. A geometry for reducing stress induced by the tapered interface may be used through at least one compliant region formed adjacent to the tapered bore and to the steel shank. The at least one compliant region may have a conical geometry, a radial geometry, a cylindrical geometry, a cubic geometry, or combinations thereof. The at least one compliant region may have a depth of 10 to 100% of a length of the carbide bolster. The tapered bore may penetrate both the front end and the base end of the carbide bolster.

The tapered interface may be fitted into the tapered bore by a mechanical fit, a bond, or combinations thereof. The tapered interface may have a ground finish. An abrasive layer of particles may be disposed to the tapered interface. The particles may comprise tungsten carbide, diamond, polycrystalline diamond, natural diamond, synthetic diamond, vapor deposited diamond, silicon bonded diamond, cobalt bonded diamond, thermally stable diamond, or combinations thereof. The particles may have a diameter of 0.500 to 100 microns. The abrasive layer of particles may be applied to the tapered interface by physical vapor deposition, chemical vapor deposition, electroplated, painted or combinations thereof.

The super hard material may comprise a substantially conical surface with a side that forms a 35 to 55 degree angle with a central axis of the tool. At the interface, the substrate may comprise a tapered surface starting from a cylindrical rim of the substrate and ending at an elevated flatted central region formed in the substrate. The flatted region may have a diameter of 0.125 to 0.250 inches. The super hard material may have a substantially pointed geometry with an apex having 0.050 to 0.165 inch radius. The super hard material and the substrate may have a total thickness of 0.200 to 0.700 inches from the apex to a base of the substrate. The super hard material may be 0.100 to 0.500 inch thick from the apex to the non-planar interface.

The super hard material may be diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The pick may have the characteristic of withstanding impact greater than 80 joules.

The high impact pick may be incorporated in drill bits, shear bits, milling machines, indenters, mining picks, asphalt picks, asphalt bits, trenching machines, or combinations thereof.

DETAILED DESCRIPTION OF THE INVENTION AND THE PREFERRED EMBODIMENT

Figure 1:
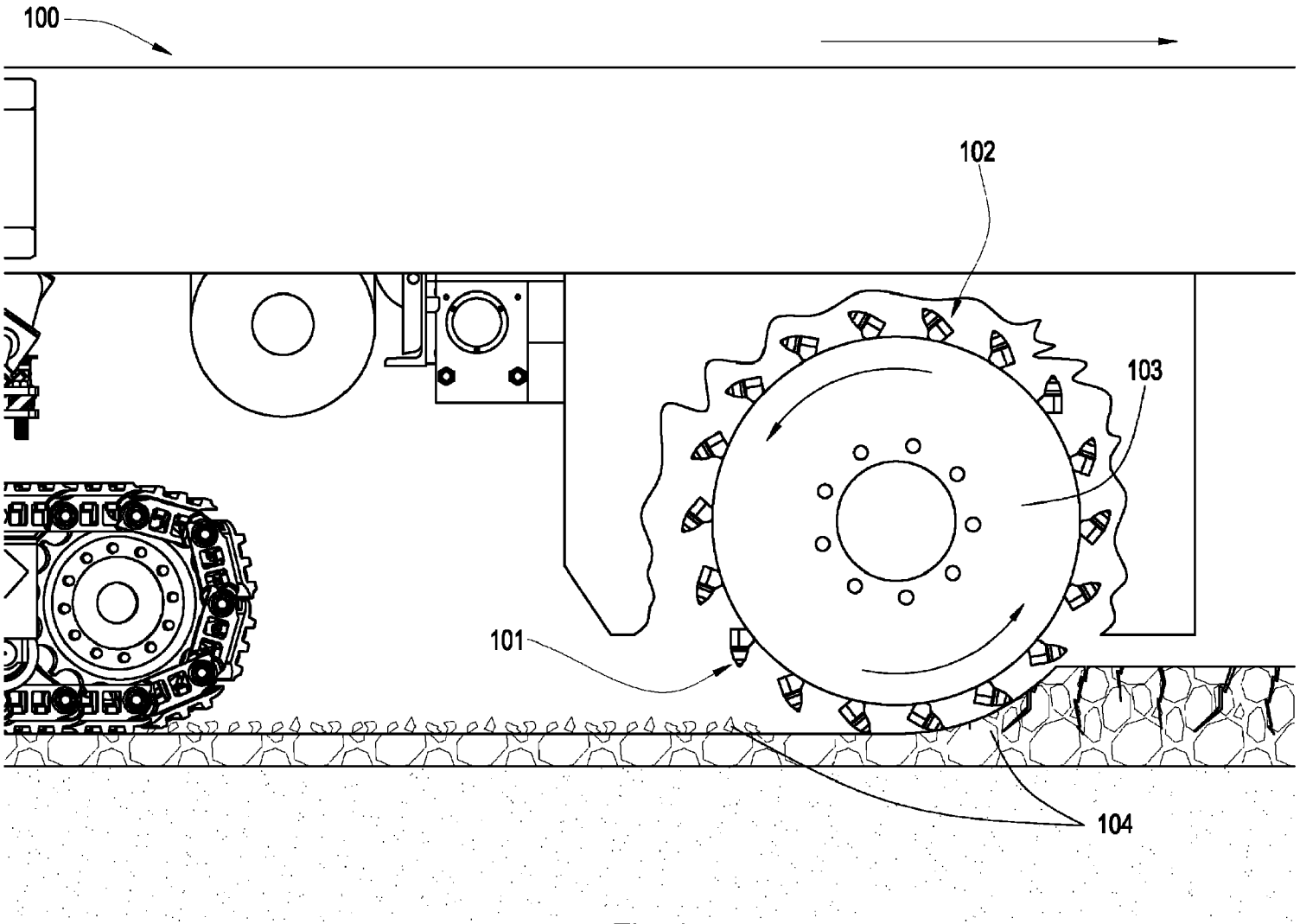
FIG. 1 is a cross-sectional diagram of an embodiment of a plurality of picks on a rotating drum attached to a motor vehicle.

FIG. 1 is a cross-sectional diagram of an embodiment of a plurality of picks 101 attached to a rotating drum 103 connected to the underside of a pavement recycling machine 100. The recycling machine 100 may be a cold planer used to degrade man-made formations such as pavement 104 prior to the placement of a new layer of pavement. Picks 101 may be attached to the drum 103 bringing the picks 101 into engagement with the formation. A holder 102 or block is attached to the rotating drum 103, and the pick 101 is inserted into the holder 102. The holder 102 or block may hold the pick 101 at an angle offset from the direction of rotation, such that the pick 101 engages the pavement at a preferential angle.

Figure 2:
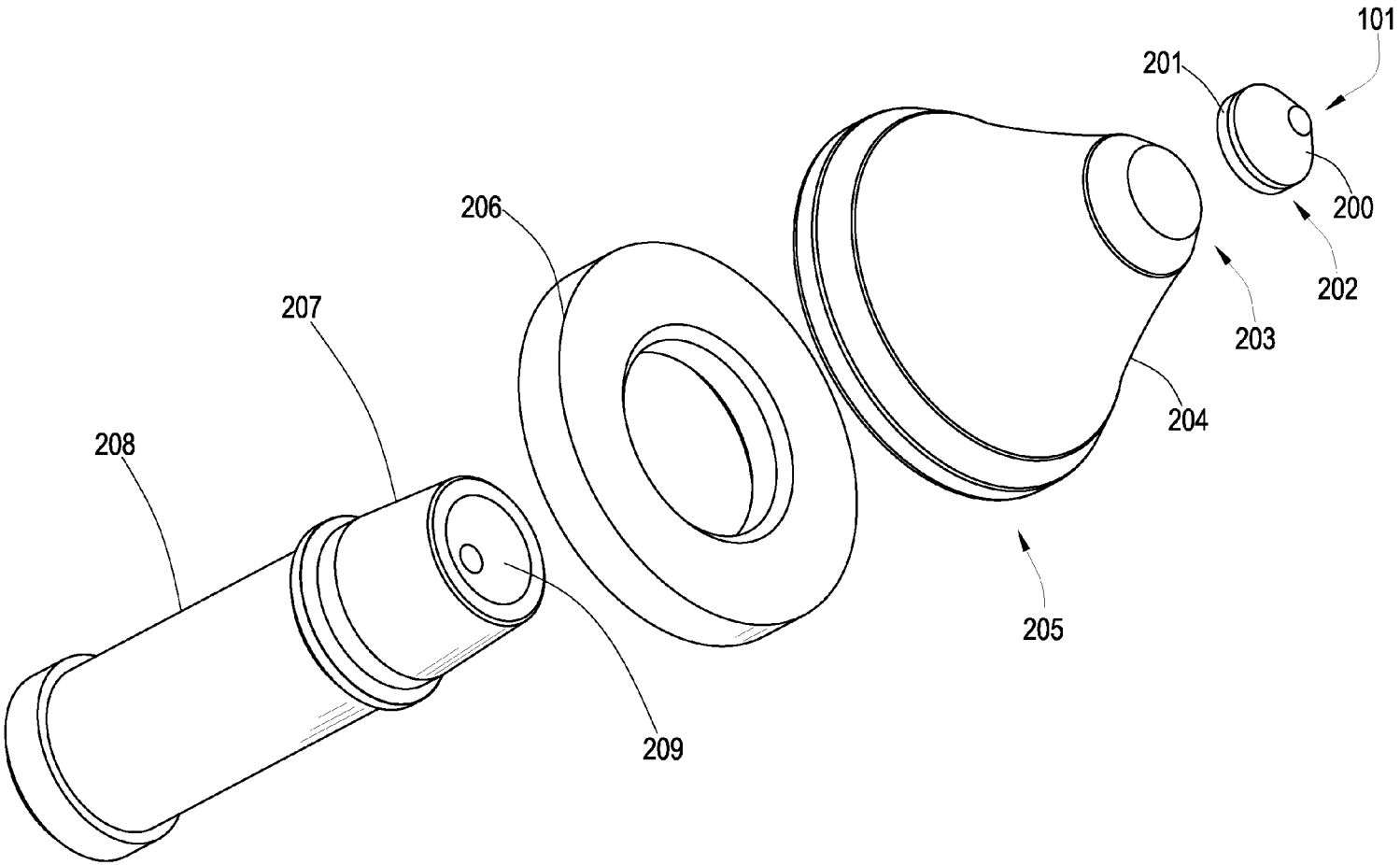
FIG. 2 is an exploded diagram of an embodiment of a pick.
Figure 3:
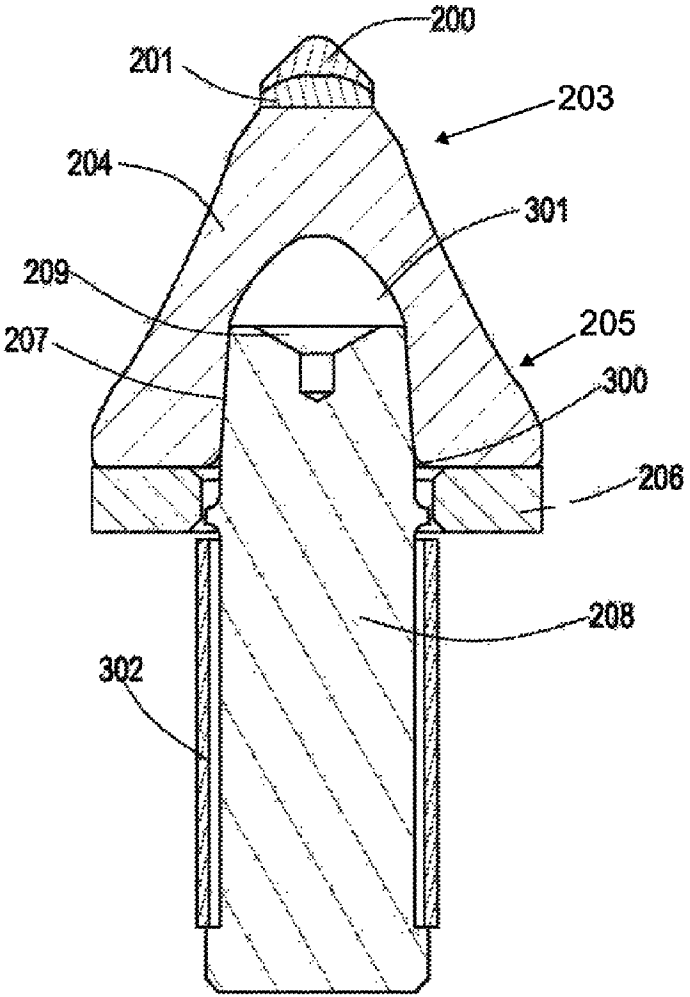
FIG. 3 is a cross-sectional diagram of an embodiment of a pick.

Now referring to FIG. 2 through 3, the pick 101 comprises a super hard material 200 bonded to a cemented metal carbide substrate 201 at a non-planar interface. Together the metal carbide substrate 201 and the super hard material form a tip 202. The cemented metal carbide substrate 201 is bonded to a front end 203 of a cemented metal carbide bolster 204. The carbide bolster 204 may have a ground finish. A tapered bore 300 is formed in the base end 205 of the carbide bolster 204 opposite the front end 203. A tapered interface 207 is formed on a steel shank 208 and is fitted into the tapered bore 300.

The tapered interface 207 may be a Morse taper of size 0 to size 7, a Brown taper size 1 to size 18, a Sharpe taper size 1 to 18, a R8 taper, a Jacobs taper size 0 to size 33, a Jarno taper size 2 to 20, a NMTB taper size 25 to 60, or modifications or combinations thereof. The tapered interface 207 may be connected to the tapered bore 300 by a mechanical fit such as a press fit; or the tapered interface 207 may be connected to the tapered bore 300 by a bond such as a braze or weld. A combination of bonds and mechanical fits may also be used to connect the tapered interface 207 to the bore 300.

To assist the connection between the tapered interface 207 and the bore 300, an abrasive layer of particles may be applied to the tapered interface 207. The particles may have a diameter of 0.500 to 100 microns and may comprise tungsten carbide, diamond, polycrystalline diamond, natural diamond, synthetic diamond, vapor deposited diamond, silicon bonded diamond, cobalt bonded diamond, thermally stable diamond, or combinations thereof. The abrasive layer of particles may be applied to the tapered interface 207 by physical vapor deposition, chemical vapor deposition, electroplating, a high pressure high temperature process, painted or combinations thereof.

A compliant region 209 may be formed in the steel shank 208 and a compliant region 301 may be formed in the carbide bolster 204. It is believed that the compliant region 209 in the shank 208 and the compliant region 301 in the bolster may reduce stress induced by the tapered interface. As disclosed in FIG. 3, the compliant region 209 may have a conical geometry, a cylindrical geometry, or combinations thereof. The compliant region 301 formed in the carbide bolster 204 may have a conical shape. A washer 206 or a sleeve 302 assist in fitting the pick 101 in a holder 102, the latter being illustrated in FIG. 1.

Figure 4:
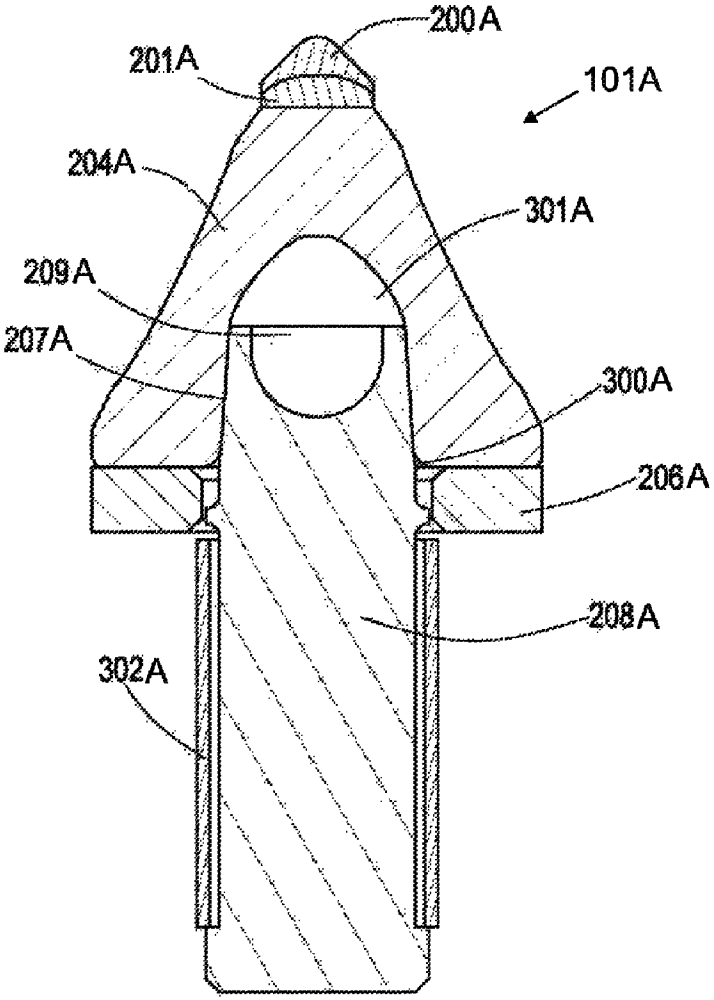
FIG. 4 is a cross-sectional diagram of another embodiment of a pick.
Figure 6:
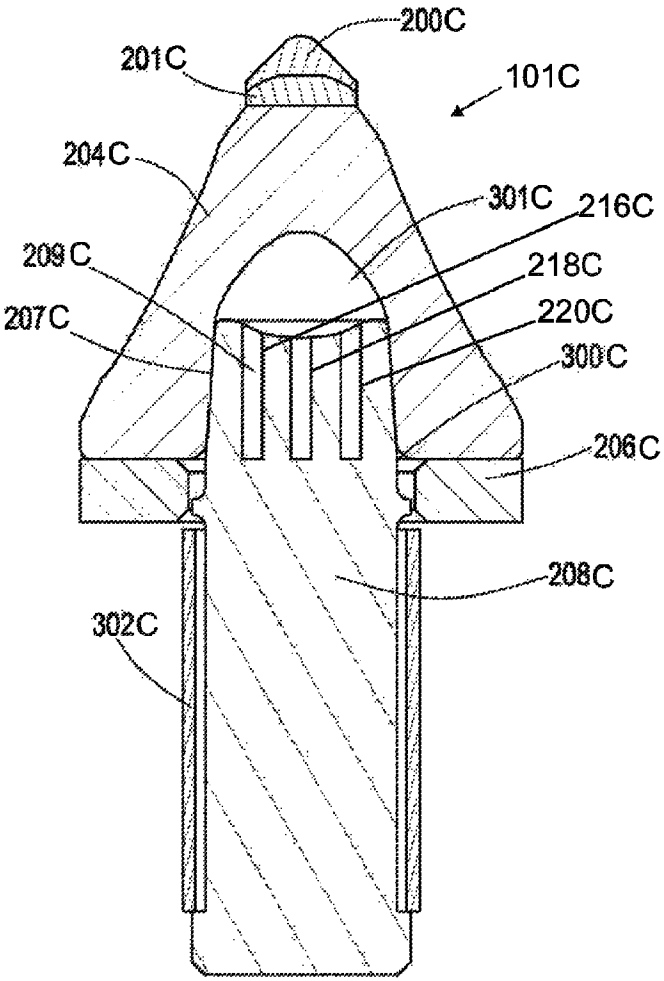
FIG. 6 is a cross-sectional diagram of another embodiment of a pick.
Figure 5:
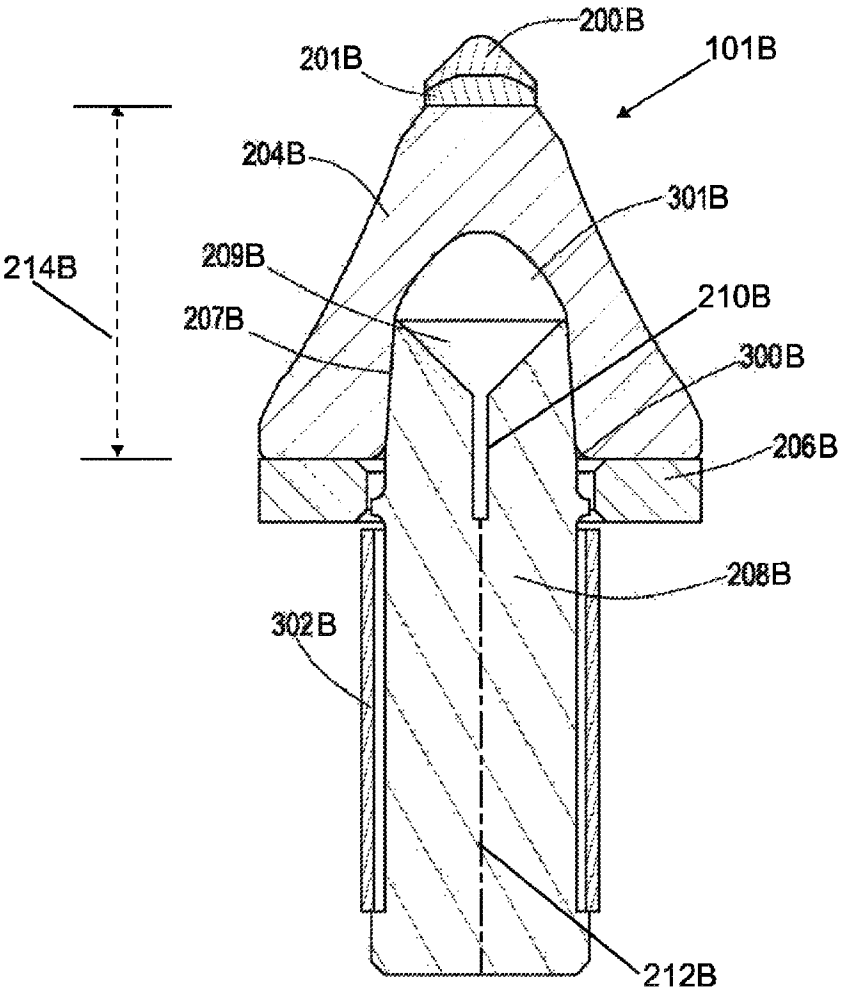
FIG. 5 is a cross-sectional diagram of another embodiment of a pick.

FIGS. 4 through 6 disclose embodiments of a pick 101 with varying compliant region 209 geometries. FIG. 4 discloses a pick 101A with a super hard material 200A bonded to a metal carbide substrate 201A. The substrate 201A is bonded to a carbide bolster 204A. The shank 208A is inserted into the tapered bore 300A which has a compliant region 301A. The tapered interface 207A is inserted into the tapered bore 300A and held in place with a fit comparable to tapered interface 207 in bore 301. A washer 206A or a sleeve 302A assist in fitting the pick 101A into a holder. The shank 208A has compliant region 209A that comprises a hemi-spherical geometry which forms a cavity in the shank 208A.

FIG. 5 discloses a pick 101B with a super hard material 200B bonded to a metal carbide substrate 201B. The substrate 201B is bonded to a carbide bolster 204B. The shank 208B is inserted into the tapered bore 300B which has a compliant region 301B. The tapered interface 207B is inserted into the tapered bore 300B and held in place with a fit comparable to tapered interface 207 in bore 301. A washer 206B or a sleeve 302B assist in fitting the pick 101B into a holder. The shank 208B has compliant region 209B having a conical shape that converges from the outside surface of the tapered interface 207B into a cylindrical shape around the center axes 212B of the steel shank 208B. The compliant region may have a depth of 10 to 100% of a length 214B of the carbide bolster 204B.

FIG. 6 discloses a pick 101C with a super hard material 200C bonded to a metal carbide substrate 201C. The substrate 201C is bonded to a carbide bolster 204C. The shank 208C is inserted into the tapered bore 300C which has a compliant region 301C. The tapered interface 207C is inserted into the tapered bore 300C and held in place with a fit comparable to tapered interface 207 in bore 301. A washer 206C or a sleeve 302C assist in fitting the pick 101C into a holder. The shank 208C has compliant region 209C comprising a plurality of slits formed in the steel shank 208C.

Figure 7:
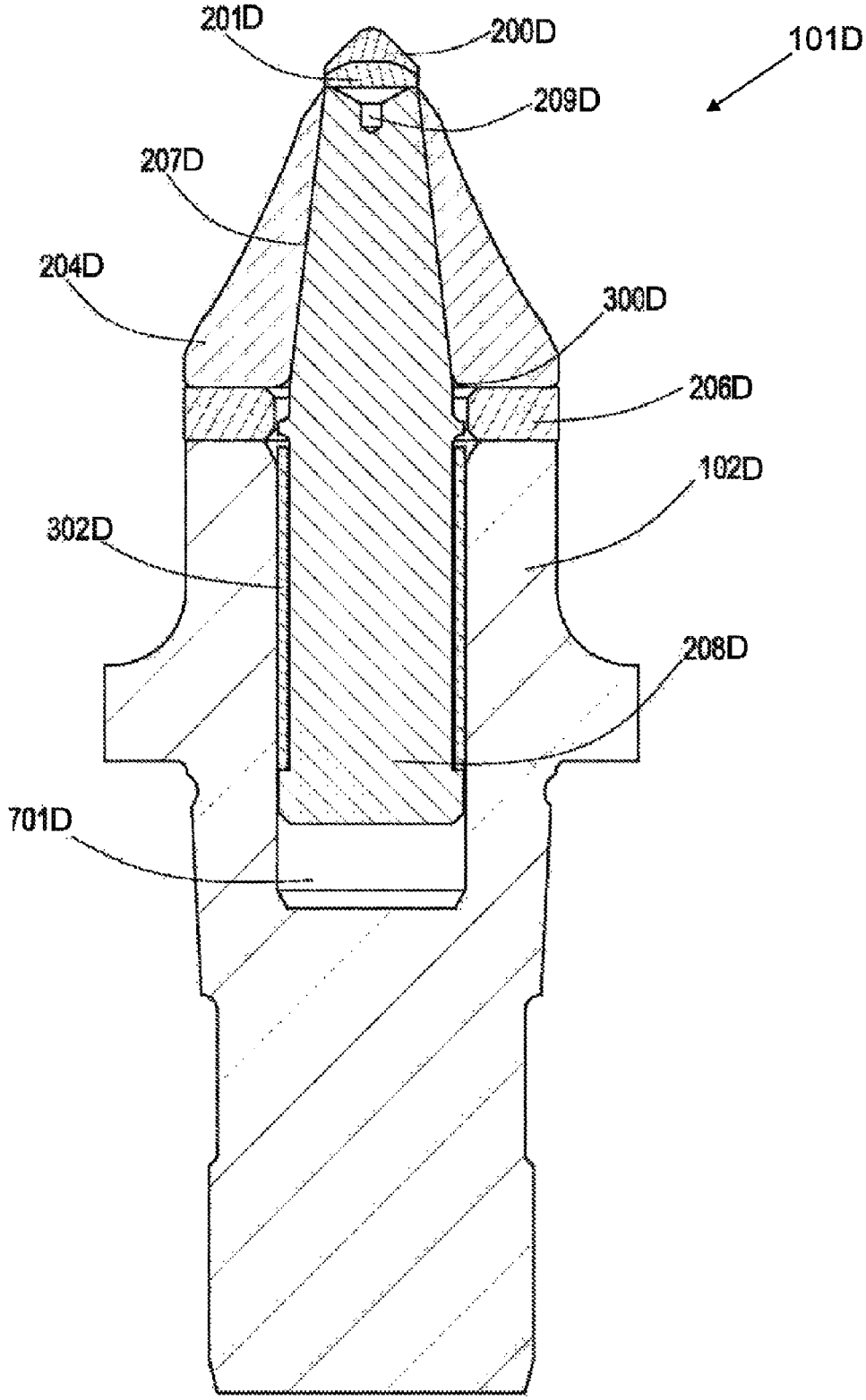
FIG. 7 is a cross-sectional diagram of another embodiment of a pick.

Now referring to FIG. 7, the bore 300D and tapered interface 207D may extend completely through the carbide bolster 204D. The carbide substrate 201D with a super hard material 200D may be connected by a braze to the steel shank 208D adjacent to the compliant region 209D. A washer 206D, a sleeve 302D, or combinations thereof may be used to assist the fit of a pick 101D to a holder 102D. The holder 102D may have a recess 701D to house the shank 208D of the pick 101D. The recess 701D may have a depth 100 to 120% the length of the shank 208D.

Figure 8:
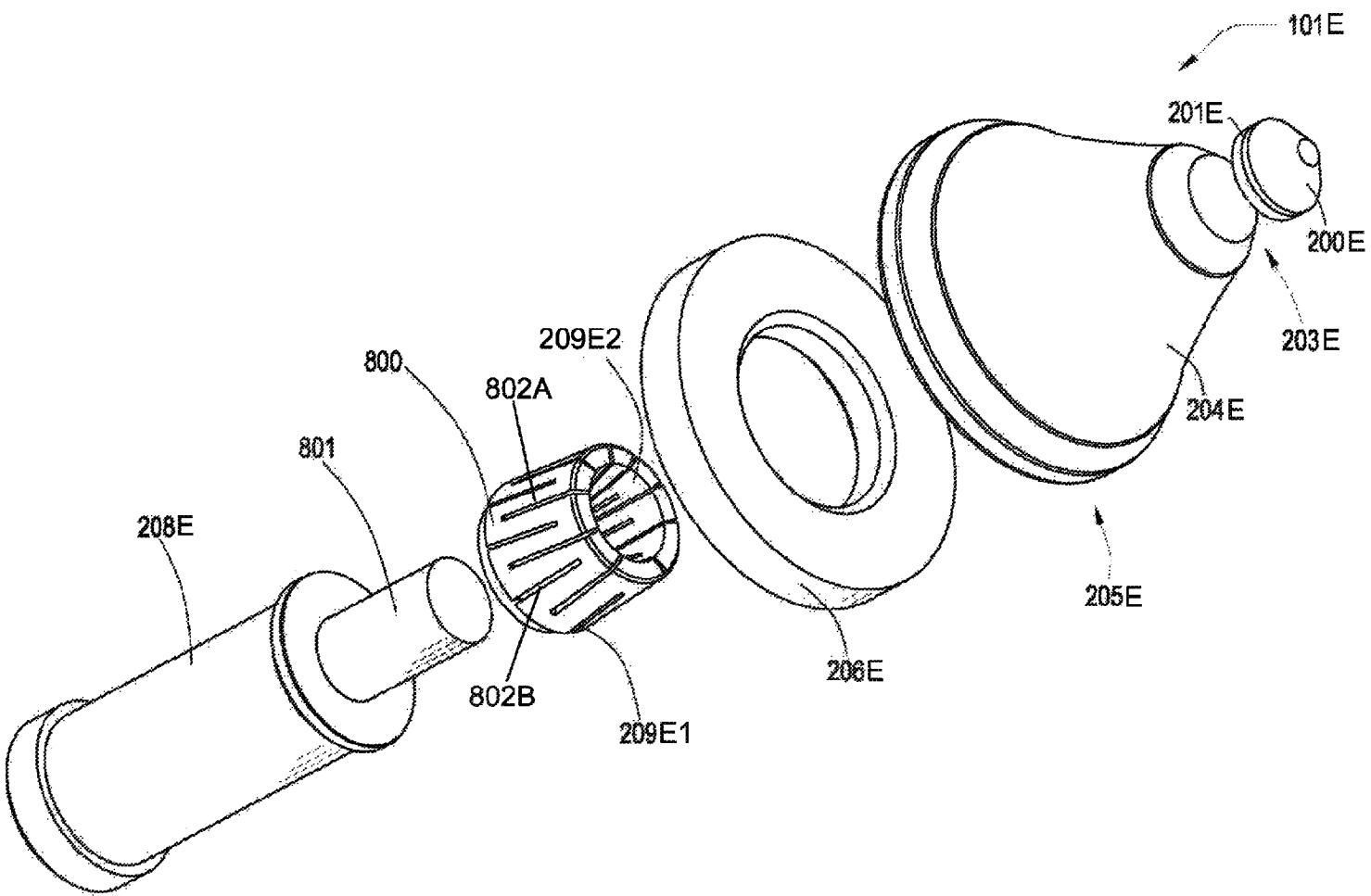
FIG. 8 is an exploded diagram of another embodiment of a pick.

FIG. 8 discloses an embodiment of a pick 101E comprising a super hard material 200E bonded to a cemented metal carbide substrate 201E at a non-planar interface. The cemented metal carbide substrate 201E is bonded to a front end 203E of a cemented metal carbide bolster 204E. A tapered bore, like bore 300 (FIG. 3), is formed in the base end 205E of the carbide bolster 204E opposite the front end 203E. A shank 208E includes a cylindrical interface 801 adapted to mate with a tapered collet 800 and washer 206E. The tapered collet 800 is adapted to fit within the tapered bore, such as bore 300. Compliant regions 209E1 and 209E2 are formed in the collet 800 and may comprise slits, such as slits 802A and 802B, or bores, or a combination thereof. It is believed that the compliant regions 209E1 and 209E2 in the collet 800 may reduce the stresses between the carbide bolster 204E and the collet 800. It is also believed that the compliant regions 209E1 and 209E2 in the collet 800 may reduce the need for high tolerances in the bore, such as bore 300 (FIG. 3), formed in the bolster 204E.

Figures 9, 9A, 9B:
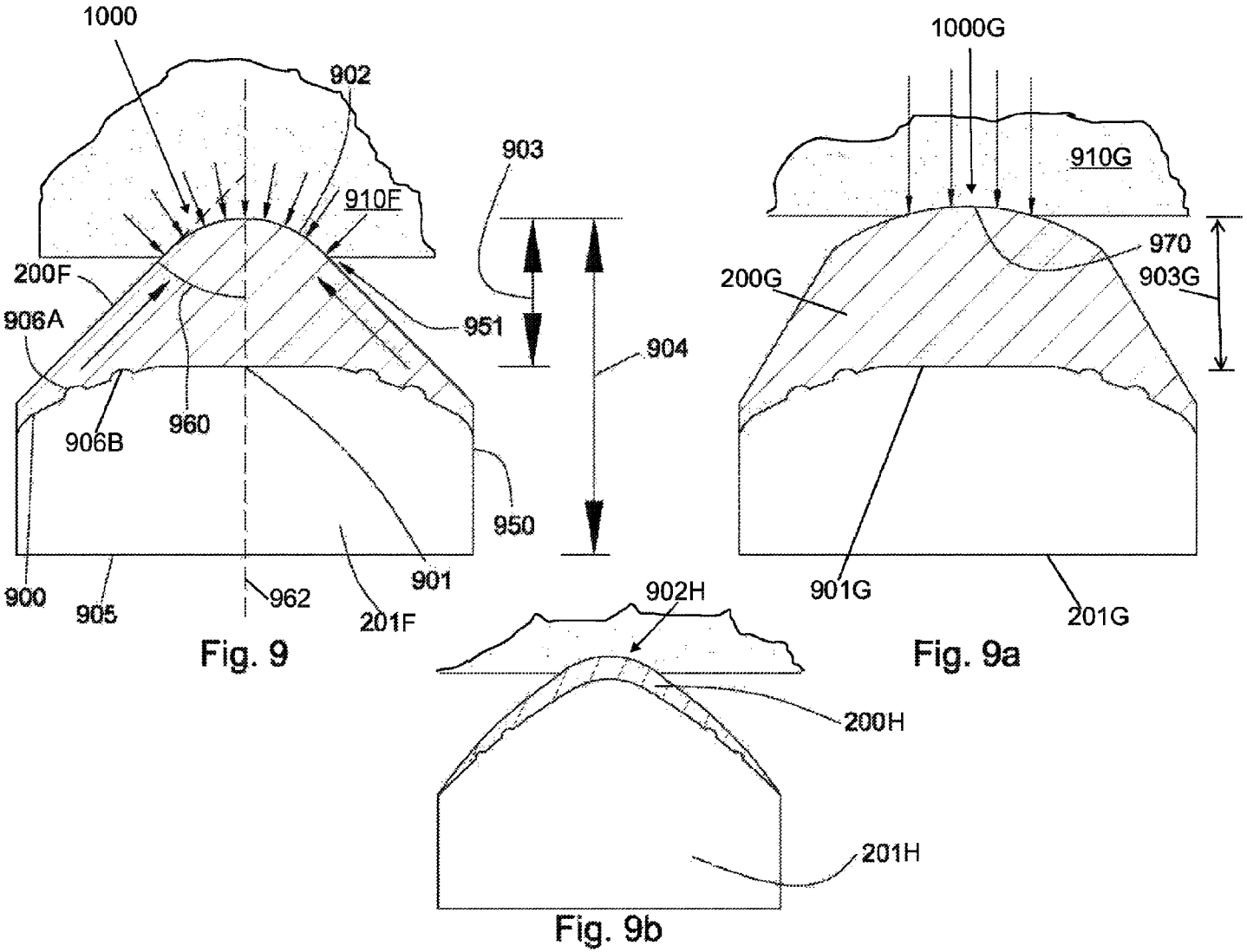
FIG. 9 is a cross-sectional diagram of an embodiment of a super hard material bonded to a substrate.
FIG. 9*a* is a cross-sectional diagram of another embodiment of a super hard material bonded to a substrate.
FIG. 9*b* is a cross-sectional diagram of another embodiment of a super hard material bonded to a substrate.

Now referring to FIG. 9, a metal carbide substrate 201F has a tapered surface 900 starting from a cylindrical rim 950 of the substrate 201F and ending at an elevated, flatted, central region 901 formed in the substrate 201F. A super hard material 200F comprises a substantially pointed geometry 1000 with a sharp apex 902 having a radius of 0.050 to 0.125 inches. It is believed that the apex 902 is adapted to distribute impact forces across the flatted region 901, which may help prevent the super hard material 200F from chipping or breaking. The super hard material 200F may a thickness 903 of 0.100 to 0.500 inches from the apex 902 to the flatted region 901 or nonplanar interface. The super hard material 200F and the substrate 201F may be 0.200 to 0.700 inches thick 904 from the apex 902 to a base 905 of the substrate 201F. The sharp apex 902 may allow the tool to more easily cleave rock or other formations.

The pointed geometry 1000 of the super hard material 200F may forms a 35 to 55 degree angle 960 with a central axis 962 of the metal carbide substrate 201F and super hard material 200F, though the angle 960 may preferably be substantially 45 degrees.

The pointed geometry 1000 may also comprise a convex side or a concave side. The tapered surface 900 of the substrate 201F may incorporate nodules 906A and 906B at the interface between the super hard material 200F and the substrate 201F, which may provide more surface area on the substrate 201F to provide a stronger interface. The tapered surface 900 may also incorporate grooves, dimples, protrusions, reverse dimples, or combinations thereof. The tapered surface 900 may be convex, as in the current embodiment, though the tapered surface may be concave.

Comparing FIGS. 9 and 9*a*, the advantages of having a pointed apex 902 as opposed to a blunt apex 970 in FIG. 9*a* may be seen. FIG. 9 is a representation of a pointed geometry 1000 which has a 0.094 inch radius apex and a 0.150 inch thickness 903 from the apex 902 to the non-planar interface 901. FIG. 9*a* is a representation of another geometry having a 0.160 inch radius apex and 0.200 inch thickness 903G from the apex 970 to the non-planar shape 901G of the substrate 201G.

The geometries of FIGS. 9 and 9*a* were compared to each other in a drop test performed at Novatek International, Inc. located in Provo, Utah. Using an Instron Dynatup 9250G drop test machine, the geometries 1000 and 1000G were secured in a recess in the base of the machine burying the substrates 201F and 201G and leaving the super hard material 200F and 200G exposed. The base of the machine was reinforced from beneath with a solid steel pillar to make the structure more rigid so that most of the impact force was felt in the super hard material 200F and 200G rather than being dampened. The target 910F and 910G are made of tungsten carbide 16% cobalt grade mounted in steel backed by a 19 kilogram weight. The target 910F and 910G were was raised to the needed height required to generate the desired potential force.

It was then dropped normally onto the geometries 1000 and 1000G. Each geometry was tested starting at 5 joules. If the geometries withstood the force, they were retested with a new carbide target like target 910F and 910G at an increased increment of force like 10 joules, until the geometries failed. The pointed apex 902 of FIG. 9 surprisingly required about 5 times more force to break than the thicker 903G geometry of FIG. 9*a*.

It is believed that the sharper geometry 1000 of FIG. 9 penetrated deeper into the tungsten carbide target 910F, thereby allowing more surface area of the super hard material 200F to absorb the energy generated from the falling target 910F by beneficially buttressing the penetrated portion of the super hard material 200F effectively converting bending and shear loading of the substrate 201F into a more beneficial compressive force drastically increasing the load carrying capabilities of the super hard material 200F. On the other hand, it is believed that since the embodiment of FIG. 9*a* is blunter, the apex 970 hardly penetrated into the tungsten carbide target 910G thereby providing little buttress support to the substrate 201G and causing the super hard material 200G to fail in shear/bending at a much lower load, despite having a larger volume using the same grade of diamond and carbide. The average embodiment of FIG. 9 broke at about 130 joules while the average geometry of FIG. 9*a* broke at about 24 joules. It is believed that since the load was distributed across a greater surface area in the embodiment of FIG. 9, it was capable of withstanding a greater impact than that of the thicker embodiment of FIG. 9*a*.

Surprisingly, in the embodiment of FIG. 9, when the pointed geometry 1000 finally broke, the crack initiation point 951 was below the radius of the apex 902. This is believed to result from the tungsten carbide target 910F pressurizing the flanks of the pointed geometry 1000 in the penetrated portion, which results in the greater hydrostatic stress loading in the pointed geometry 1000. It is also believed that since the radius was still intact after the break that the pointed geometry 1000 will still be able to withstand high amounts of impact, thereby prolonging the useful life of the pointed geometry 1000 even after chipping.

Three different types of geometries were tested. One geometry is disclosed in FIG. 9*b* and has a 0.035 inch super hard material 200H and an apex 902H with a 0.094 inch radius. This type of geometry broke with a force in the 8 to 15 joules range. The blunt geometry of FIG. 9*a* with Ate radius of 0.160 inches and a thickness of 0.200 broke with a force in the 20-25 joule range. The pointed geometry 1000 of FIG. 9 with the 0.094 thickness and the 0.150 inch thickness broke with a force of about 130 joules. The impact force measured when the super hard material 200G with the 0.160 inch radius broke was 75 kilo-newtons. Although the Instron drop test machine was only calibrated to measure up to 88 kilo-newtons, the pointed geometry 1000 exceeded that force when it broke. But the inventors were able to extrapolate that the pointed geometry 1000 of FIG. 9 probably experienced about 105 kilo-newtons when it broke.

The super hard material like super hard materials 200F, 200G and 200H having the feature of being thicker than 0.100 inches or having the feature of a 0.075 to 0.125 inch radius is not enough to achieve the super hard material's optimal impact resistance, but it is synergistic to combine these two features. In the prior art, it was believed that a sharp radius of 0.075 to 0.125 inches of a super hard material such as diamond would break if the apex, like apex 902, were too sharp. Thus rounded and semispherical geometries are commercially used today.

The performance of the present invention is not presently found in commercially available products or in the prior art. U.S. patent application Ser. No. 11/766,975 filed on Jun. 22, 2007, which is herein incorporated by reference for all that it contains, discloses a drop test that may be compatible with the present invention.

Figures 10, 10A, 10B, 10C, 10D, 10E, 10F, 10G:
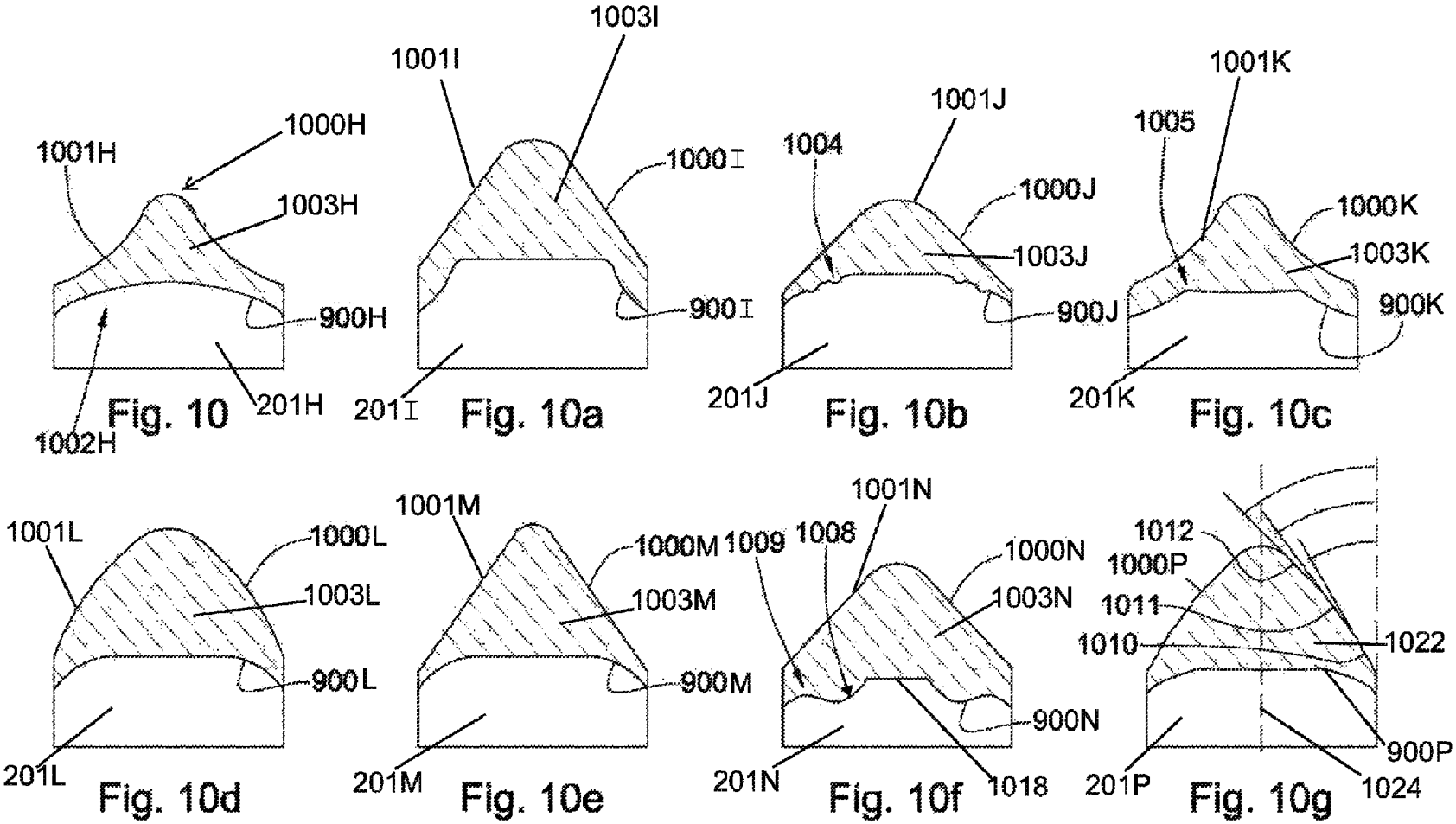
FIG. 10 is a cross-sectional diagram of another embodiment of a super hard material bonded to a substrate.
FIG. 10*a* is a cross-sectional diagram of another embodiment of a super hard material bonded to a substrate.
FIG. 10*b* is a cross-sectional diagram of another embodiment of a super hard material bonded to a substrate.
FIG. 10*c* is a cross-sectional diagram of another embodiment of a super hard material bonded to a substrate.
FIG. 10*d* is a cross-sectional diagram of another embodiment of a super hard material bonded to a substrate.
FIG. 10*e* is a cross-sectional diagram of another embodiment of a super hard material bonded to a substrate.
FIG. 10*f* is a cross-sectional diagram of another embodiment of a super hard material bonded to a substrate.
FIG. 10*g* is a cross-sectional diagram of another embodiment of a super hard material bonded to a substrate.

FIGS. 10 through 10*f* disclose various embodiments of super hard material like super hard materials 1003H-N having different combinations of interfaces like interfaces 900H-N and shapes like pointed shapes 1000H-N. FIG. 10 illustrates the pointed shape 1000H with a concave side 1001H and a continuous convex shape 1002H of the metal carbide substrate 201 H at the interface 900H.

FIG. 10*a* shows an embodiment of a thicker super hard material 1003I in a conical shape 1000I having a flat side 1001I from the apex to the non-planar interface which is interface 9001 of metal carbide substrate 2011, while still maintaining the radius of 0.075 to 0.125 inches at the apex 1001I.

FIG. 10*b* shows an embodiment with super hard material 1003J having a pointed shape 1000J having a flat side 1001J. Grooves 1004 are formed in the metal carbide substrate 201J to increase the strength of the interface 900J.

FIG. 10*c* shows an embodiment with super hard material 1003K having a pointed shape 1000K with a concave side 1001K. The interface 900K has a portion which is slightly concave 1005.

FIG. 10*d* illustrates an embodiment in which the super hard material 1003L has a pointed shape 1000L with a slightly convex sides 1001L while still maintaining the 0.075 to 0.125 inch radius. The interface 900L is slightly concave with a flatted region.

FIG. 10*e* depicts a pointed shape 1000M of the super hard material 1003M that is conical with a flat sided 1001M. The metal carbide substrate 201M is formed to have an interface 900M which is slightly concave at its outer region with a flat region.

FIG. 10*f* shows a super hard material 1003N with a pointed shape 1000N having a rounded apex and a flat side 1001 N. The metal carbide substrate 201N is formed to have concave and convex portions 1008, 1009 201 with a generally flatted central portion 1018 of an interface 900N.

Now referring to FIG. 10*g*, the super hard material 1022 has a pointed shape 1000P having a convex surface comprising different general angles at a lower portion 1010, a middle portion 1011, and an upper portion 1012 with respect to the central axis 1024. The lower portion 1010 of the side surface may be angled at substantially 25 to 33 degrees from the central axis 1024, the middle portion 1011, which may make up a majority of the convex surface, may be angled at substantially 33 to 40 degrees from the central axis 1024, and the upper portion 1012 of the side surface may be angled at about 40 to 50 degrees from the central axis 1024. The metal carbide substrate 201P is formed with an interface 900P comparable to the interfaces 900L and 900M.

Figure 11:
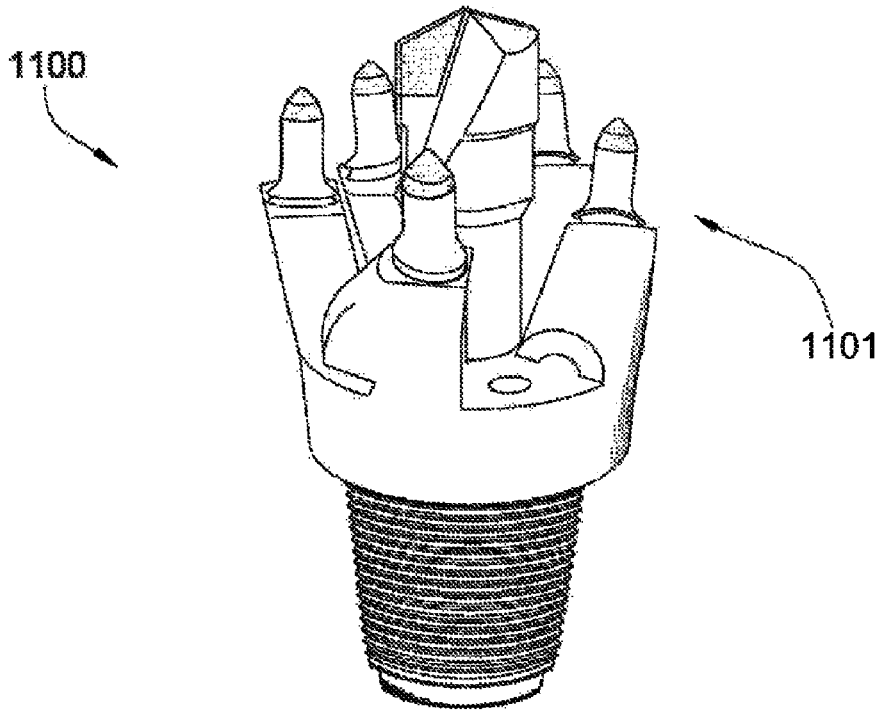
FIG. 11 is an orthogonal diagram of an embodiment of a drill bit.
Figure 12:
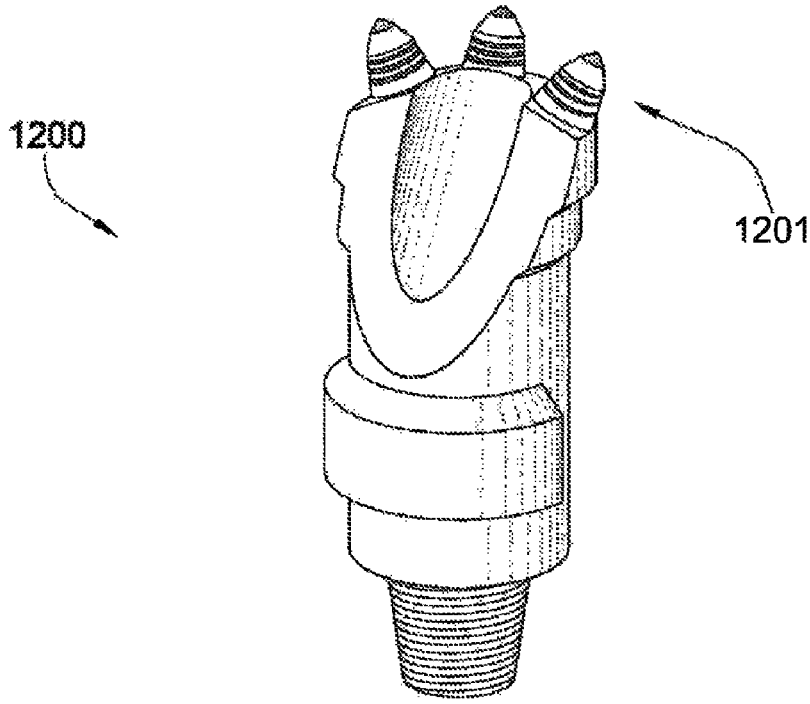
FIG. 12 is an orthogonal diagram of another embodiment of a drill bit.

Picks 101 may be used in various applications. FIGS. 11 through 15 disclose various wear applications that may be incorporated with the present invention. FIG. 11 discloses a drill bit 1100 typically used in water well drilling. It has a plurality of picks of bits 1101 FIG. 12 discloses a drill bit 1200 typically used in subterranean, horizontal drilling and includes has a plurality of picks or bits 1201. These drill bits 1100, 1200, and other bits, may be consistent with the present invention.

Figure 13:
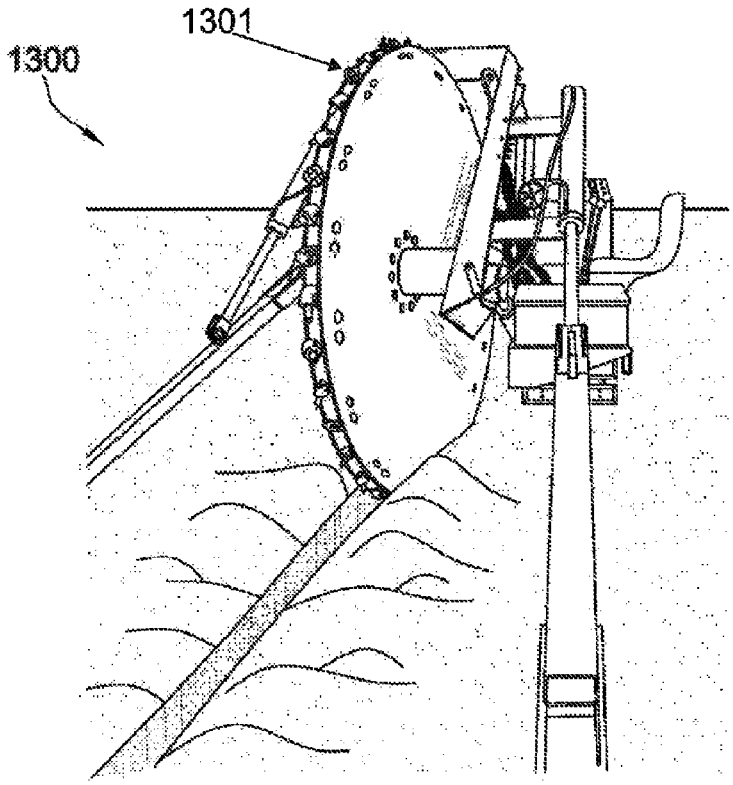
FIG. 13 is a perspective diagram of an embodiment of a trencher.
Figure 14:
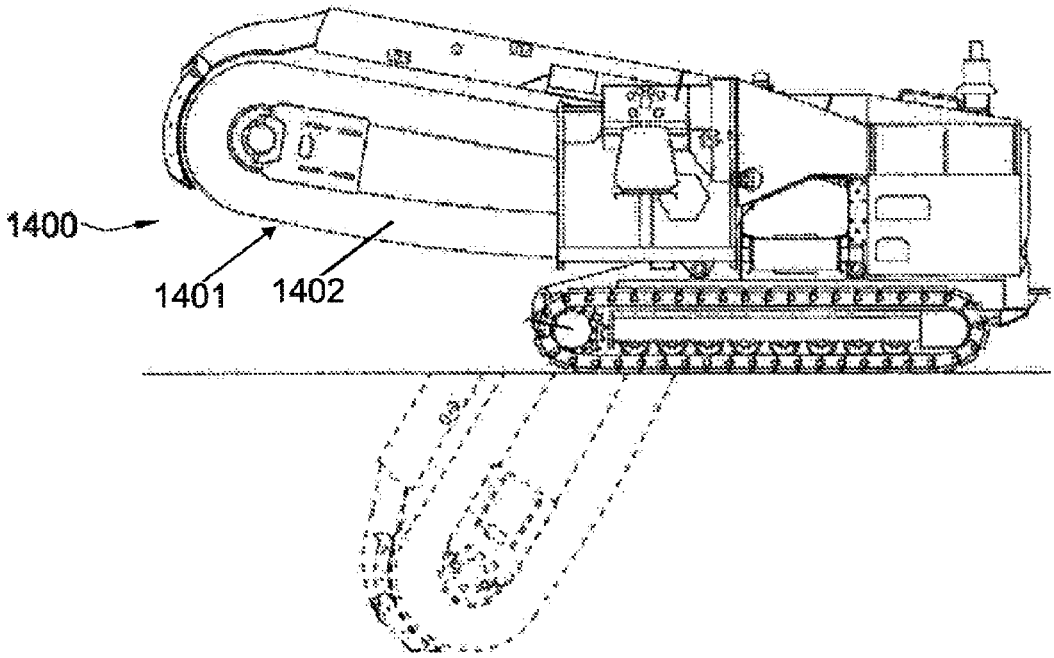
FIG. 14 is an orthogonal diagram of another embodiment of a trencher.

A pick like pick 1301 may be used in a trenching machine, as disclosed in FIGS. 13 and 14. Picks 1301 may be disposed on a rock wheel trenching machine 1300 as disclosed in FIG.

13. Referring to FIG. 14, the picks 1401 may be placed on a chain that rotates around an arm 1402 of a chain trenching machine 1400.

Figure 15:
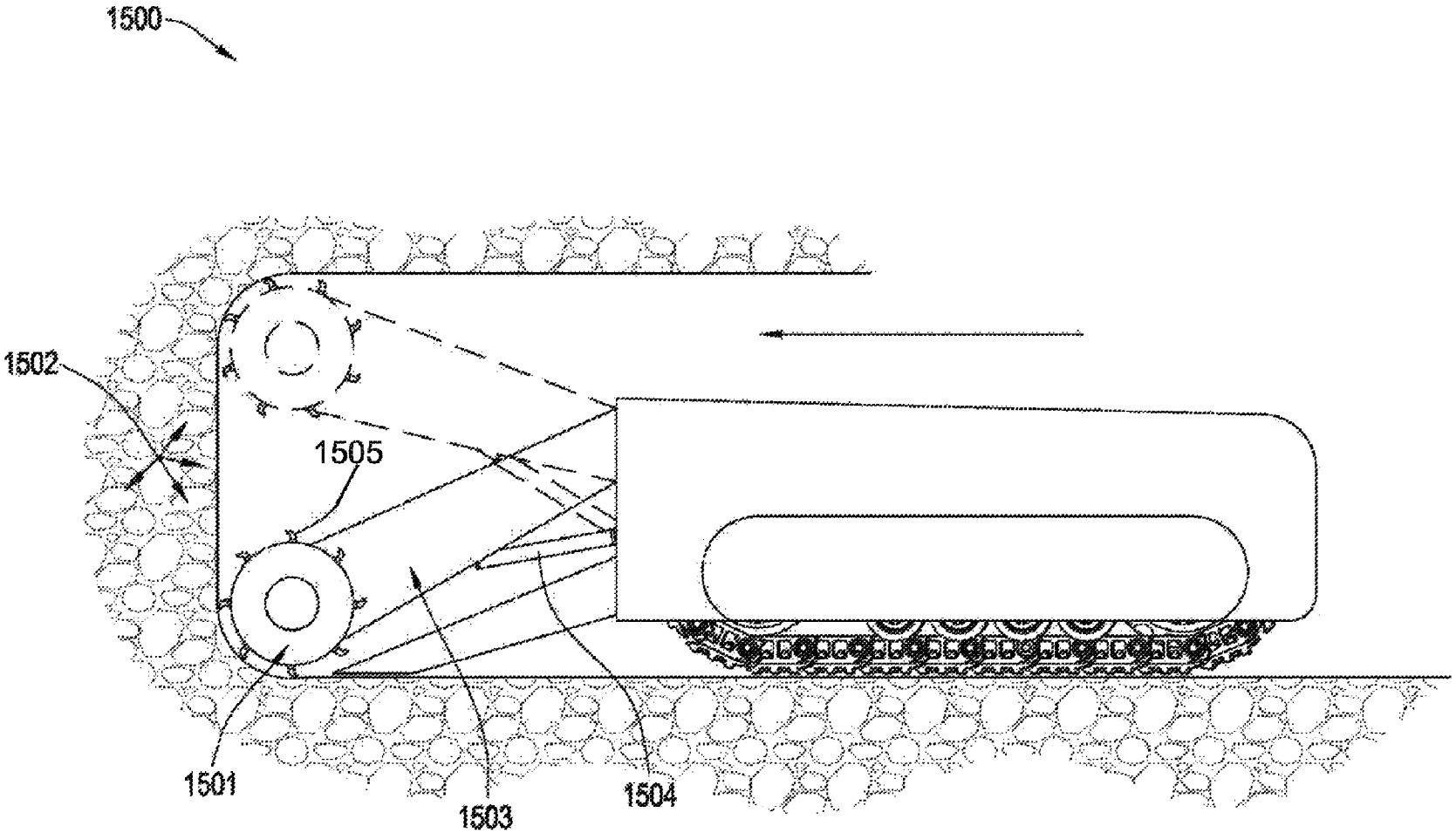
FIG. 15 is an orthogonal diagram of an embodiment of a coal trencher.

FIG. 15 is an orthogonal diagram of an embodiment of a coal trencher 1500. A plurality of picks like pick 1505 are connected to a rotating drum 1501 that is degrading coal 1502. The rotating drum 1501 is connected to an arm 1503 that moves the drum 1501 vertically in order to engage the coal 1502. The arm 1503 may be moved by that of a hydraulic arm 1504. It may also pivot about an axis or a combination thereof. The coal trencher 1500 may move about by tracks, wheels, or a combination thereof. The coal trencher 1500 may also move about in a subterranean formation. The coal trencher 1500 may be in a rectangular shape providing for easy mobility about the formation.

Other applications that involve intense wear of machinery may also be benefited by incorporation of the present invention. Milling machines, for example, may experience wear as they are used to reduce the size of material such as rocks, grain, trash, natural resources, chalk, wood, tires, metal, cars, tables, couches, coal, minerals, chemicals, or other natural resources.

Whereas the present invention has been described in particular relation to the drawings attached hereto, it should be understood that other and further modifications apart from those shown or suggested herein, may be made within the scope and spirit of the present invention.

What is claimed is:

1. A high impact resistant pick, comprising:

a metal carbide substrate having a non-planar interface and a surface opposite said non-planar interface;

a super hard material bonded to said non-planar interface of said cemented metal carbide substrate;

a cemented metal carbide bolster having a front end and a base end spaced from said front end, said cemented metal carbide substrate being attached to said first end of said cemented metal carbide bolster, said cemented metal carbide bolster having a tapered bore formed in said base end extending toward said front end; and a steel shank with a tapered interface sized to fit into said tapered bore, said steel shank having an end for insertion into said tapered bore with a compliant region formed therein at said end.

2. The high impact resistant pick of claim 1, wherein the tapered interface is shaped to have one of a Morse taper, a Brown taper, a Sharpe taper, a R8 taper, a Jacobs taper, a Jarno taper, and a NMTB taper.

3. The high impact resistant pick of claim 1, wherein said compliant region is a recess formed in said end of said steel shank.

4. The high impact resistant pick of claim 1, where in said cemented metal carbide bolster has a length and wherein said compliant region has a depth from about 10% to about 85% of said length of said carbide bolster.

5. The high impact resistant pick of claim 1, wherein the tapered interface has a ground finish.

6. The high impact resistant pick of claim 1, wherein said cemented metal carbide bolster has a central axis, and wherein said super hard material is formed to have a substantially conical surface with a side of said conical surface forming an angle with said central axis from about 35 degrees to about 55 degrees.

7. The high impact resistant pick of claim 1, wherein said cemented metal carbide substrate is cylindrical in shape with an exterior rim, wherein said non-planar interface of said cemented metal carbide substrate has a tapered surface extending from said exterior rim toward an elevated flatted central region formed centrally in said cemented metal carbide substrate.

8. The high impact resistant pick of claim 7, wherein said flatted region has a diameter of 0.125 to 0.250 inches.

9. The high impact resistant pick of claim 1, wherein said super hard material is formed to have an apex with a radius from about 0.050 to 0.165 inches.

10. The high impact resistant pick of claim 9, wherein said super hard material and said cemented metal carbide substrate are sized to have a total thickness of about 0.200 to about 0.700 inches.

11. The high impact resistant pick of claim 9, wherein said super hard material is formed to be from about 0.100 to about 0.500 inch thick from said apex to said non-planar interface.

12. The pick of claim 10, wherein said super hard material is formed from at least one of diamond particles, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, and metal catalyzed diamond.

13. A degradation machine comprising:

a driving mechanism coupled to a tool for contacting a material to be degraded by moving said tool against said material, said tool including:

a high impact pick, said high impact tip including a metal carbide substrate having a non-planar interface and a surface opposite said non-planar interface;

a super hard material bonded to said non-planar interface of said cemented metal carbide substrate;

a cemented metal carbide bolster having a front end and a base end spaced from said front end, said metal carbide substrate being attached to said first end of said cemented metal carbide bolster, said cemented metal carbide bolster having a tapered bore formed in said base end extending toward said front end; and, a steel shank with a tapered interface sized to fit into said tapered bore, said steel shank having an end for insertion into said tapered bore with a compliant region formed therein at said end.

14. The high impact resistant pick of claim 1, wherein said tapered bore has an inner end and is formed to have a compliant region at said inner end.

15. The high impact resistant pick of claim 3, wherein said recess is conical.

16. The high impact resistant pick of claim 3, wherein said recess is cylindrical.

17. The high impact resistant pick of claim 3, wherein said recess includes a conical section having an inner end with a cylindrical section extending inward into said steel shank from said inner end.

* * * * *